United States Patent [19]

Carlson

[11] 3,941,040

[45] Mar. 2, 1976

[54] FUME HOOD

[75] Inventor: Arthur W. Carlson, Muskegon, Mich.

[73] Assignee: E. H. Sheldon and Company, Muskegon, Mich.

[22] Filed: Feb. 12, 1975

[21] Appl. No.: 549,349

[52] U.S. Cl. ..... 98/115 LH; 55/DIG. 18; 108/150

[51] Int. Cl.[2] ..... F23J 11/00

[58] Field of Search ..... 98/36, 115 R, 115 LH; 108/150; 55/DIG. 18, 467

[56] References Cited

UNITED STATES PATENTS

| | | | |
|---|---|---|---|
| 1,194,527 | 8/1916 | McNamara | 98/36 |
| 3,228,317 | 1/1966 | Westman | 98/1 |
| 3,426,512 | 2/1969 | Nesher | 98/115 LH |
| 3,444,799 | 5/1969 | Covington | 98/1 |
| 3,498,032 | 3/1970 | Scott | 98/115 R |
| 3,537,381 | 11/1970 | Austin | 98/115 R |

*Primary Examiner*—William E. Wayner
*Assistant Examiner*—Ronald C. Capossela
*Attorney, Agent, or Firm*—Dawson, Tilton, Fallon & Lungmus

[57] ABSTRACT

A fume hood includes a polygonal-shaped work top providing three or more equally-spaced work areas. A tubular column with a lower apertured portion is located at the center of the work top for exhausting heavier-than-air gases. A plenum located above the work top and supported by the tubular column is provided with slots located above the work openings for collecting and exhausting lighter-than-air gases. Transparent viewing screens permit inspection of all work locations from a single vantage point. A central pedestal is used to support the hood and to route plumbing and electrical conduits from the floor. The system is easily convertible between up-draft and down-draft exhaust without the need for special baffles.

8 Claims, 7 Drawing Figures

FUME HOOD

BACKGROUND AND SUMMARY

The present invention relates to fume hoods of the type which are used in science labs for schools. Fume hoods of this type, of course, are well-known and have been used in science laboratories for many years. Most of the prior fume hoods have been adapted to be mounted or placed against a vertical wall so that access or use of the hood was gained primarily through one side of the hood. Further, an instructor, in the case of a hood mounted flush against the wall, normally was constrained to a location behind the student, and could not readily view a student's work within the hood.

Another problem with fume hoods of the type with which the present invention is concerned is that of adapting the hood system to different types of exhaust. Typically, a fume hood is exhausted through a ceiling (called an updraft exhaust), and in the past, most systems have been designed for this primary type of exhaust. However, there are circumstances in which it is desired to exhaust the fume hood through a floor or downwardly (called a down-draft exhaust). In the past, special baffling and re-routing of exhaust conduits were required in order to convert an up-draft exhaust system to one having a down-draft exhaust.

Briefly, the fume hood of the present invention includes a base having a work top of polygonal shape, preferably octagonal. The sides of the hexagonal shape are alternately relatively long and relatively short, the longer sides providing the work areas. A plenum having the same horizontal cross section as the base is located above the base and provides the top of the fume hood. The plenum is supported by a tubular column which extends between the centers of the base and plenum.

Transparent viewing screens extend between the shorter sides respectively between the lower base and upper plenum to separate the work areas while permitting an instructor to view the entire interior of the fume hood from a single location. Eye-screens, including a movable baffle are located above the work areas, the baffle being provided to adjust the velocity of intake air, if desired.

The lower portion of the tubular column is apertured for drawing in heavier-than-air gases within the hood, and the lower side of the plenum includes slots located above the respective work areas for drawing in lighter-than-air gases. In an up-draft exhaust hood, the gases entering at the lower portion of the tubular column are drawn upwardly and combined with the gases in the plenum for exhaust through an upper discharge conduit. In a downdraft exhaust hood, the plenum gases are routed downwardly through the central tubular column where they are combined with the lighter-than-air gases, and both are exhausted through a lower discharge conduit extending through a central pedestal upon which the fume hood is mounted.

Plumbing and electrical conduits are also routed from the floor through the central pedestal to the base of the hood so that they are hidden from view. Overhead lights may also be mounted in the plenum for providing interior light, with the conduits being routed from the base to the plenum through the tubular column.

With the present invention, it has been found that the face velocity of room air through the work openings is quite uniform throughout the entire work opening, whether the fume hood is used with an up-draft exhaust or a downdraft exhaust, and without the need for special baffling or complicated exhaust conduits. Further, the uniform face velocity of room air is achieved whether the movable eyescreens at each work opening are in a raised or a lowered position.

Thus, the present invention provides a laboratory fume hood wherein a number of students may use the hood simultaneously, each having his own work area, but also having convenient access to chemicals or supplies within the hood. At the same time, an instructor may view all that is transpiring in the hood from a single viewing position.

Other features and advantages of the present invention will be apparent to persons skilled in the art from the following detailed description of a preferred embodiment, accompanied by the attached drawing, wherein identical reference numerals will refer to like parts in the various views.

THE DRAWING

DETAILED DESCRIPTION

Figure 1:
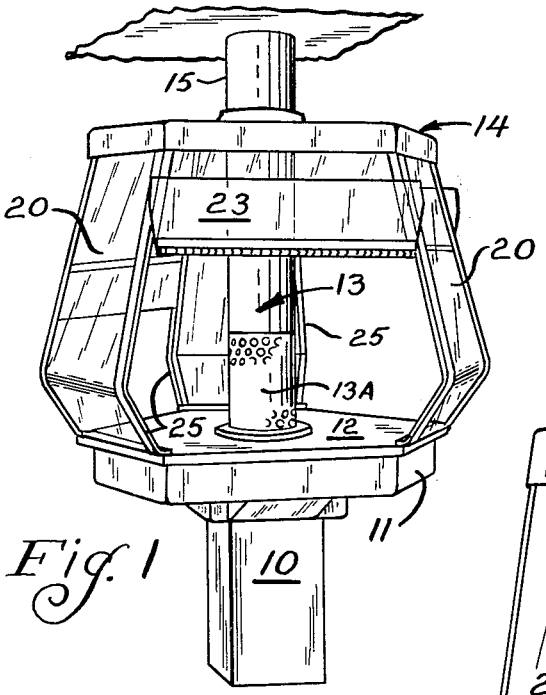
FIG. 1 is a perspective view of a fume hood incorporating the present invention, and adapted for updraft exhaust.
Figure 2:
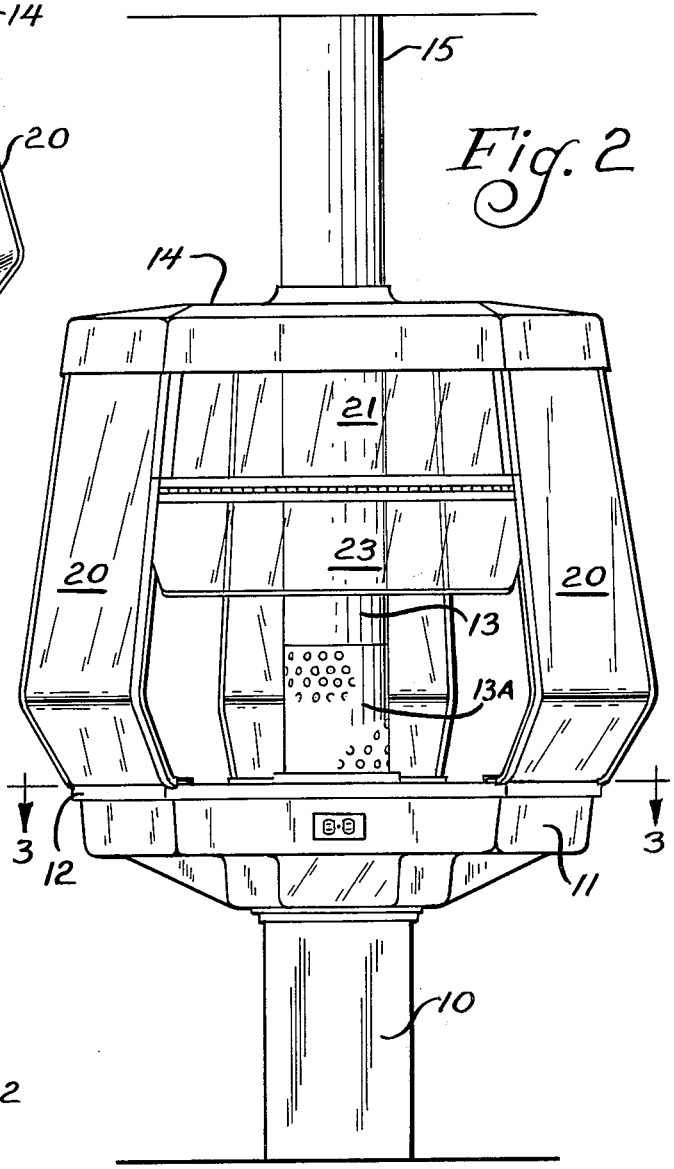
FIG. 2 is a side view of the fume hood of FIG. 1 looking directly into a work opening.

Referring first to FIGS. 1 and 2, a fume hood includes a supporting pedestal generally designated 10, on the top of which is mounted a hollow base 11. To the top of the base 11 there is secured a work surface or top 12. Extending upwardly from the central portion of the work surface 12 is a tubular column 13 of circular cross section and serving a number of functions. One of the functions of the centrally located tubular column 13 is to conduct fumes from within the hood. Another function of the element 13 is to serve as a means for routing electrical conduit and wiring to overhead lights, as will be discussed. Still another function of the tubular element 13 is to serve as a structural column to support an overhead plenum, generally designated by reference numeral 14. As will be more fully explained below, when the fume hood is set up for down-draft, the exhaust gases flow downwardly in the tubular column 13; and when the system is set up for up-draft, the exhaust gases flow upwardly in the column 13. In the case of an up-draft system, an upper exhaust conduit 15 serves as a discharge conduit for gases within the fume hood collected both from within the plenum 14 and the column 13. The lower portion of the column 13 is perforated as at 13A to draw the gas into it.

Figure 3:
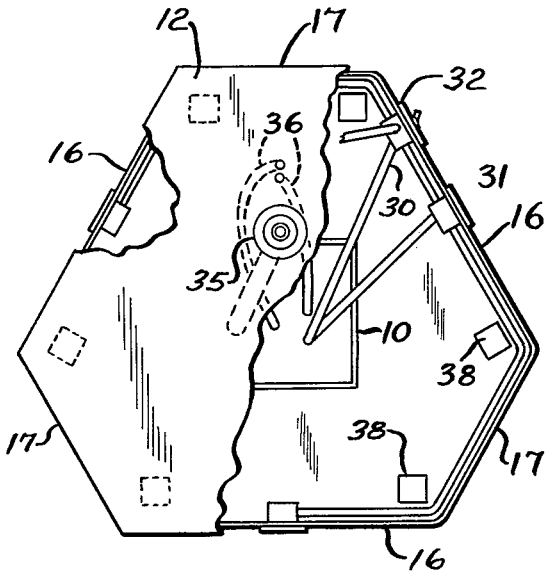
FIG. 3 is a horizontal view taken along the sight line 3—3 of FIG. 2, with portions of the work surface cut away to show the interior of the base.
Figure 6:
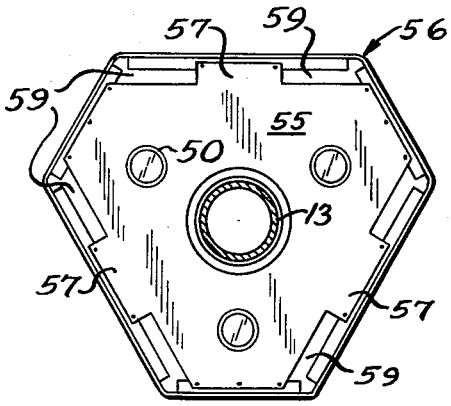
FIG. 6 is a bottom view of the plenum of the fume hood.

Referring now to FIGS. 3 and 6, in horizontal section, the base 11 (and the associated work top 12) and the plenum 14 have a corresponding hexagonal shape, characterized by three relatively long sides, designated 16 in FIG. 3 and three relatively short sides 17, extending between adjacent of the longer sides 16. This general type of shape, in a table, has been disclosed in U.S. Pat. No. 3,741,852 of Keener, issued June 26, 1973, for "Segmental Multi-Unit Study Table".

Referring again to FIGS. 1 and 2, relatively narrow transparent viewing screens 20 extend between the respective narrow sides of the base 11 and plenum 14 to partially enclose the hood. The upper portion of each of the larger spaces or "work openings" (defined by the corresponding larger sides 16 of the base 11 and plenum 14) are provided with upper viewing screens 21 which extend to partially cover the work opening, as illustrated.

At the lower end of each of the viewing screens 21 to which a movable baffle or eye-screen 23 is mounted by means of hinge 22. The eye-screen is seen in the raised position in FIG. 1 and in the lowered position in FIG. 2. The eye-screen 23 serves a dual function. That is, it provides for an adjustment for the air velocity through the three work openings, designated 25; and, in the lowered position seen in FIG. 2, it provides protection for the eyes of the student at a work opening. The material which is preferably used for the viewing screens 20, 21 and the eye-screen 23 is a shatterproof polycarbonate plastic which has a smoke tint, although the latter is primarily for aesthetic purposes. This material is characterized as being non-combustible, non-breakable and as giving off a non-toxic smoke when burned. The work top 12 may be any material suitable for use in laboratory tables, preferably having a substantial resistance to acid and flame.

The structure just described thus provides for three work spaces provided at equal angular spacing about the hood so that all students have equal access to work materials, gas and water within the hood. Further, an instructor has a clear view of all that is going on within the hood; i.e., at all work stations. This concept could easily be extended to provide more work stations, if desired.

Turning now to FIG. 3, it will be observed that the pedestal 10 has a square cross section, although this is not necessary for the practice of the invention. However, the pedestal 12 serves to route electrical conduits such as those designated 30 to outlets 31 or switches 32 for overhead lights or other electrical appliances, including an exhaust fan. Further, the drain of a sink 35 mounted to the work surface 12 is also routed through the pedestal 10, as are hot and cold water conduits 36, feeding a fixture, the base of which is seen at 36A in FIG. 5.

Figure 4:
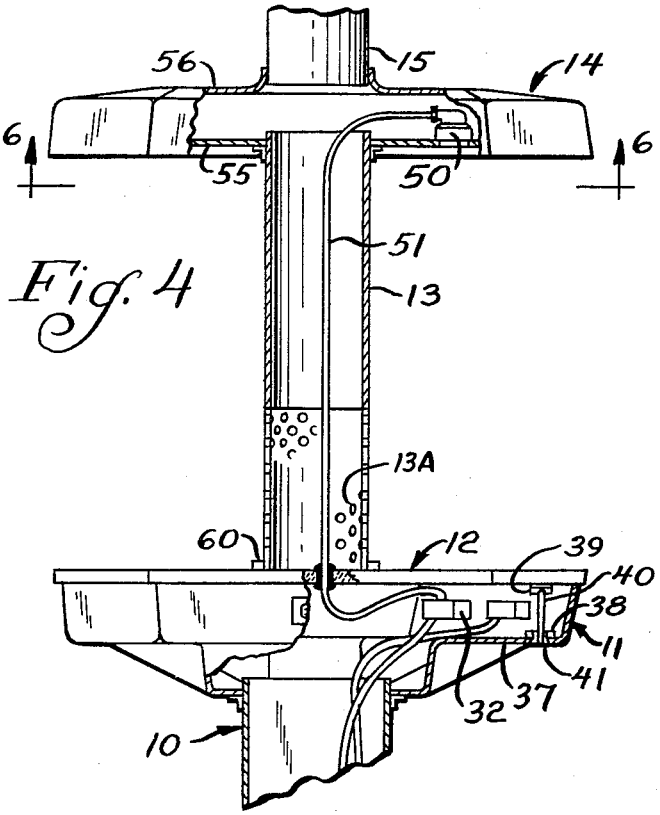
FIG. 4 is a vertical view of the fume hood of FIG. 1 with portions shown in cross section and without the viewing screens.

Referring now to FIG. 4, it will be observed that the base 11 is in the form of a shell, thereby providing a hollow interior for the conduits, switches, etc. Portions of the shell 11, such as that designated 37 are formed into horizontal lands which are provided with reinforcement plates 38. In vertical register with the reinforcement plates 38 and attached to the lower surface of the work top 12 is a receptacle 39 for a hook member 40 which extends downwardly through the reinforcing plates 38 and is secured by means of an internally threaded ferrule 41.

The lower portion 13A of the tubular column 13 is apertured to admit air from the space defined by the viewing screens into the conduit 13 for exhaust, as mentioned. Further, it will be observed from FIG. 4 that the plenum 14 is hollow and admits air from the upper portion of the space defined by the viewing screens either into the exhaust conduit 15 (in the case of an up-draft exhaust) or to the tubular column 13 (in the case of a down-draft exhaust).

Still referring to FIG. 4, an overhead light 50 is mounted to the undersurface 55 of the plenum 14, the electricity being routed through a conduit 51 extending through the tubular column 13, base 12 and pedestal 10.

Three such lights may be provided at equally spaced increments about the plenum 14 to light the interior of the hood.

Referring now to FIG. 6, the bottom 55 of the plenum 14 is provided by a plate which extends beneath an inverted shell 56 of the same horizontal section as the base 11. However, the plate 55 is dimensioned so that its edges corresponding to the longer edges of the octagon are spaced inwardly of the corresponding edge of the shell 56 to define elongated slots 59. A tab 57, which is a part of the plate 55, extends into the center of the slots 59, dividing it into two sections for each of the work openings. These slots communicate lighter-than-air gases from the top of the interior of the fume hood into the plenum 14, and cooperate with the perforated lower portion 13A of the tubular column 13 to equalize the air flow distribution through the work openings and to cause the air velocity (sometimes referred to as face velocity) of incoming room air to be substantially uniform throughout the length and breadth of the associated work opening for both positions of the eye-screen 23.

Figure 5:
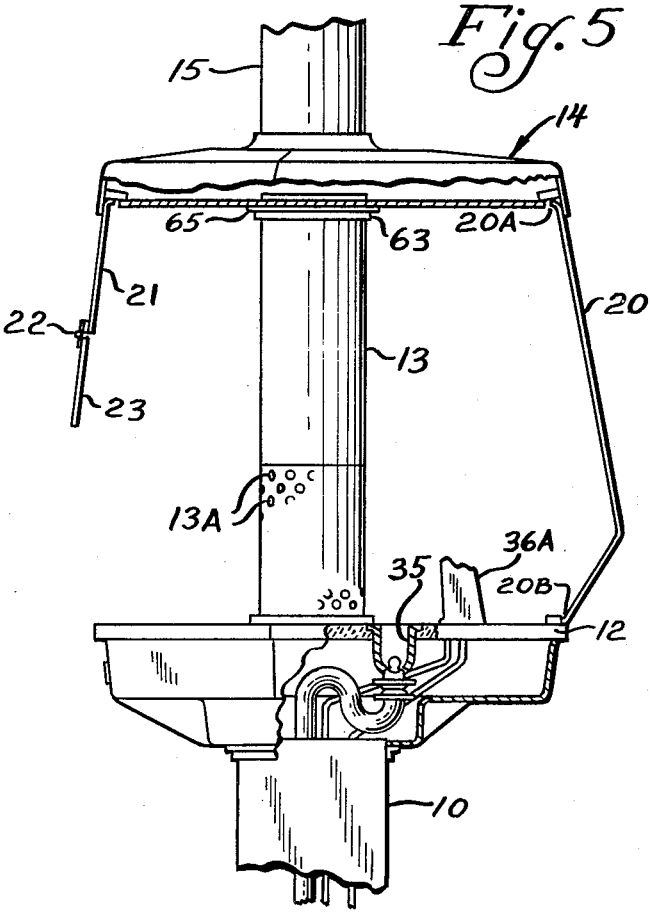
FIG. 5 is a vertical view similar to FIG. 4 but with the fume hood rotated 60°.

As seen in FIG. 5, the viewing screens 20 are provided with inwardly turned upper and lower flanges 20A and 20B for securing the screen respectively to the plenum 14 and the work top 12. This prevents tilting of the top of the hood, and insures that only axial hoods are borne by the central tubular column 13, thereby simplifying the mounting of the column.

Figure 7:
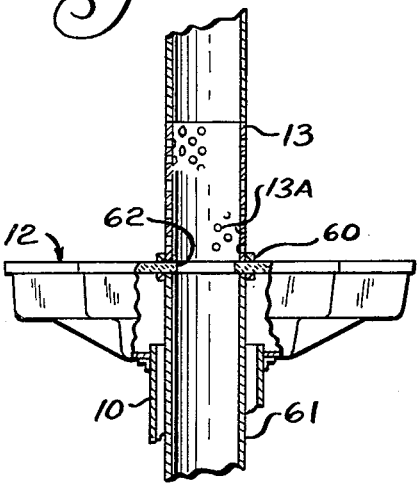
FIG. 7 is a fragmentary vertical view, partially broken away, of a fume hood incorporating the present invention and adapted for down-draft exhaust.

The tubular column 13, in the case of an up-draft exhaust, as seen in FIG. 4, rests on the work top 12, held in place by an annular member 60 secured to the top 12. If it is desired to use the fume hood in a system having a down-draft exhaust, a suitable opening 62 is cut in the center of the work top 12 beneath the tubular element 13 as seen in FIG. 7; and an extension conduit 61 is provided to couple the gas through the pedestal 10 to an exhaust outlet. In this case, the upper discharge conduit 15 need not be used, the corresponding plenum opening may be closed.

As seen in FIG. 5, the plenum 14 is mounted to the upper portion of the tubular column 13 by means of a mounting ring 63 having an outwardly-extending mounting flange 65.

In operation, when providing an up-draft exhaust, heavier-than-air gases within the fume hood are communicated through the perforations or apertures 13A at the base of the tubular column 13; and they are routed upwardly through the column 13 and plenum 14 into the discharge conduit 15. The lighter-than-air gases in the upper portion of the hood are drawn in through the slots 59, and flow through the plenum 14 and into the discharge conduit 15.

In the case of a down-draft exhaust, the lighter-than-air gases are again communicated through the slots 59 and into the plenum 14, but thence downwardly through the tubular column 13. In this case, the heavier-than-air gases within the hood are communicated through the apertures 13A and thence downwardly to conduit 61 for exhaust. In either case, and this is considered an important feature of the invention, whether the fume hood is operated as an up-draft or a down-draft exhaust, there is no substantial change in the input air flow pattern or in the face velocity of the incoming air passing through the work openings.

Tests have shown that for the case of a down-draft hood exhausting approximately 1,500 cubic feet per minute, with the eye-screens 23 in the down or closed position, the face velocity varied between 80 and 90 feet per minute. Similarly, in an up-draft hood, exhausting 1,650 cubic feet per minute, the face velocity (with the eye-screen down) varied only between 90 and 100 feet per minute. With the eye-screens up and exhausting 1,650 cubic feet per minute, using the hood as an up-draft hood, the variation in face velocity for the incoming air over the entire work opening varied between 60 and 80 feet per minute, although in the lower corners of the work opening the air velocity was reduced to 40 feet per minute.

To achieve the uniform results just mentioned, the cooperation between the intake of gas through the base of the column 13 as well and the upper slots 59 located in the bottom of the plenum immediately above the work openings is important.

I claim:

1. A fume hood comprising: a base having a polygonal horizontal cross section including edges which are alternately relatively long and relatively short, the longer edges defining work areas; a work top on said base; a central hollow pedestal adapted for mounting on a floor and carrying said base; a central tubular column extending upwardly of said base and defining a lower apertured region for intake of gases; a plenum above said base and defining the top of said fume hood, said plenum providing intake apertures above said work areas; transparent viewing screens extending between the relatively shorter edges of said base and said plenum to separate said work areas; and exhaust conduit means for exhausting gases collected from within said hood by said tubular column and by said plenum.

2. The system of claim 1 wherein said exhaust conduit means is connected to the top of said plenum and extends above the same for exhausting gases collected in said plenum and routed upwardly through said tubular column in an up-draft exhaust.

3. The system of claim 1 wherein said exhaust conduit means is located within said pedestal and communicates with the lower portion of said tubular element for exhausting gases collected within said tubular element and gases collecting within said plenum and routed downwardly through said tubular column in a down-draft exhaust.

4. The system of claim 1 wherein the horizontal cross sectional shape of said base is hexagonal and wherein said plenum has a corresponding cross sectional shape with corresponding sides of said base and said plenum being located in vertical register.

5. The system of claim 1 further comprising transparent eye-screens above each of said work stations and extending between adjacent viewing screens; and a transparent eye-protection baffle pivotally secured to the lower edge of each of said eye screens for movement between a raised and a lowered position for adjusting the face velocity of room air entering said hood at each of said work stations.

6. The system of claim 1 further comprising electrical and plumbing conduits extending through said pedestal into said base for coupling to respective outlets, whereby said conduits are hidden from view.

7. The system of claim 6 further comprising light fixture means mounted within said plenum for providing down-lighting, and electrical conduit means coupling electricity from within said base through said tubular column and to said light means.

8. A fume hood comprising: a hollow pedestal adapted to be located on a floor; a base shell mounted to said pedestal and having an upper horizontal hexagonal cross section with alternate relatively long and relatively short sides, said relatively long sides providing work areas; a top mounted to said base and conforming to the shape thereof; a central tubular column extending upwardly from said top and defining lower apertures for collecting heavier-than-air gases within said hood; a plenum mounted to the top of said tubular column and carried thereby, said plenum defining input apertures located above said work areas for collecting lighter-than-air gases within said hood, said plenum having the same cross sectional shape as the top of said base and in register therewith; a transparent viewing screen extending between each of the shorter sides of said base and said plenum; transparent eye-screens above each of said work areas and including a baffle movable between a lowered position and a raised position; and exhaust conduit means for exhausting gases collected in said plenum and said tubular column.

* * * * *